US011913289B2

(12) United States Patent
Dreier

(10) Patent No.: US 11,913,289 B2
(45) Date of Patent: Feb. 27, 2024

(54) DRILL ROD COUPLING AND METHOD FOR ACTUATING THE DRILL ROD COUPLING

(71) Applicant: BAUER Maschinen GmbH, Schrobenhausen (DE)

(72) Inventor: Robert Dreier, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 17/998,458

(22) PCT Filed: May 5, 2021

(86) PCT No.: PCT/EP2021/061895

§ 371 (c)(1),
(2) Date: Nov. 10, 2022

(87) PCT Pub. No.: WO2021/228663

PCT Pub. Date: Nov. 18, 2021

(65) Prior Publication Data

US 2023/0193698 A1 Jun. 22, 2023

(30) Foreign Application Priority Data

May 12, 2020 (EP) ..... 20174084

(51) Int. Cl.
*E21B 17/03* (2006.01)
*E21B 17/046* (2006.01)

(52) U.S. Cl.
CPC ..... *E21B 17/03* (2013.01); *E21B 17/0465* (2020.05)

(58) Field of Classification Search
CPC ..... E21B 17/03; E21B 17/0465
See application file for complete search history.

(56) References Cited

U.S. PATENT DOCUMENTS 3,231,032 A * 1/1966 Genberg ..... E21B 6/00 173/112
4,410,055 A * 10/1983 Kessler ..... E21B 10/32 175/173

(Continued)

FOREIGN PATENT DOCUMENTS

DE 100 23 467 C1 9/2001
DE 20 2005 020 729 U1 6/2006

(Continued)

OTHER PUBLICATIONS

International Preliminary Report on Patentability issued in PCT/EP2021/061895; completed Aug. 3, 2022.

(Continued)

*Primary Examiner* — Shane Bomar
(74) *Attorney, Agent, or Firm* — Studebaker & Brackett PC

(57) ABSTRACT

The invention relates to a drill rod coupling having a sleeve-shaped coupling receptacle, a pin-shaped coupling member which can be inserted axially into the coupling receptacle to form a torque proof connection, and at least one locking bolt which is directed transversely to the axial coupling direction and extends, in a locked coupling position, between the coupling receptacle and the coupling member into a locking recess, wherein the locking bolt is mounted so as to be radially adjustable between an unlocking position and a locking position. Efficient coupling is achieved in that a tensioning device is provided by means of which the locking bolt is pressed into its locking position with a predefined tensioning force, and in that the locking bolt is connected to a resetting member by means of which the locking bolt can be reset into the unlocking position when a resetting force is applied.

16 Claims, 19 Drawing Sheets

(56) References Cited

U.S. PATENT DOCUMENTS

Figure 1:
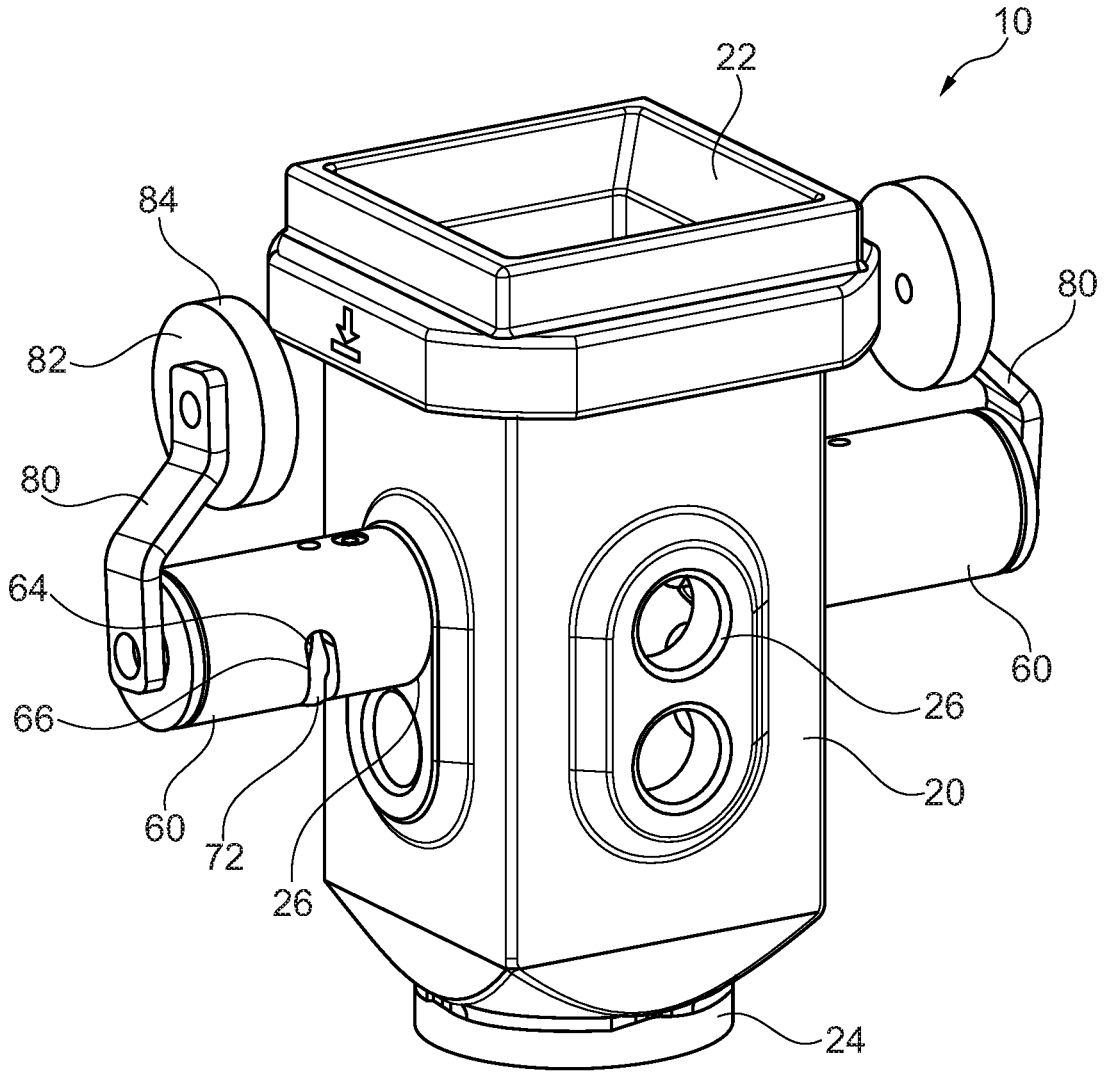

| | | | | |
|---|---|---|---|---|
| 5,002,129 | A * | 3/1991 | Hopper | E21B 41/10 285/308 |
| 6,682,107 | B2 * | 1/2004 | Munk | E21B 17/04 285/321 |
| 8,328,242 | B2 * | 12/2012 | Guidry | F16L 19/0206 285/321 |
| 8,550,167 | B2 * | 10/2013 | Comeaux | E21B 33/035 166/85.1 |
| 2010/0307832 | A1 * | 12/2010 | Mock | E21B 23/042 175/99 |
| 2015/0176337 | A1 * | 6/2015 | Ditillo | E21B 7/005 175/84 |
| 2021/0277756 | A1 * | 9/2021 | Lastra | E21B 43/128 |

FOREIGN PATENT DOCUMENTS

| | | |
|---|---|---|
| DE | 10 2006 022 613 A1 | 11/2007 |
| DE | 10 2011 109 001 A1 | 1/2013 |

OTHER PUBLICATIONS

International Search Report issued in PCT/EP2021/061895; dated Jul. 8, 2021.

* cited by examiner

DRILL ROD COUPLING AND METHOD FOR ACTUATING THE DRILL ROD COUPLING

The invention relates to a drill rod coupling having a sleeve-shaped receptacle, a pin-shaped coupling member which can be inserted axially into the coupling receptacle to form a torque proof connection, and at least one locking bolt which is directed transversely to the axial coupling direction and extends, in a locked coupling position, between the coupling receptacle and the coupling member into a locking recess, wherein the locking bolt is mounted so as to be radially adjustable between an unlocking position and a locking position, according to the preamble of claim 1.

The invention further relates to a method for actuating said drill rod coupling according to claim 15.

Such a drill rod coupling is known, for example, from DE 10 2011 109 001 A1. This drill rod coupling is often also referred to as a so-called Kelly box. In the inserted coupling position, axial locking is effected by inserting a transversely directed locking bolt into the coupling receptacle and the coupling member so that form-fit connection is achieved.

The known drill rod coupling, however, requires manual actions by operating personnel both during locking and unlocking. These are time-consuming in essence. In addition, with drilling tools, which can be several meters long and which are usually oriented vertically, the coupling arrangements can be several meters above the ground. Climbing aids or even lifting vehicles are therefore required for operation, which is also costly. In addition, work at greater heights above the ground and also within the immediate range of action of a drill rod is problematic for reasons of occupational safety and should therefore be reduced to a necessary minimum.

The object underlying the invention is to specify a drill rod coupling and a method therefor, with which a particularly efficient coupling of a drill rod is made possible.

According to the invention, the object is achieved by a drill rod coupling according to claim 1 and a method according to claim 15. Preferred embodiments are indicated in the dependent claims.

The drill rod coupling according to the invention is characterized in that a tensioning device is provided by means of which the locking bolt is pressed into its locking position with a predefined tensioning force, and in that the locking bolt is connected to a resetting member by means of which the locking bolt can be reset into the unlocking position when a resetting force is applied.

A basic concept of the invention can be seen in providing an at least semi-automatic drill rod coupling in which the at least one locking bolt is always reliably located in the locking position. This is achieved by providing a tensioning device, preferably a tension spring, with which the locking bolt is pressed into the locking position with a predefined tensioning force. Unlocking can then take place via a resetting member which is actuated manually or in an energy-driven manner in order to move the at least one locking bolt into its retracted unlocking position or release position.

The arrangement according to the invention achieves a fail-safe operation in which locking is ensured even in the event of a failure of electrical or hydraulic power at a drilling rig. Only one direction of force application is required to actuate the locking bolts, namely when the coupling is to be unlocked. Locking takes place immediately through the tensioning device when the resetting force is cancelled.

With the drill rod coupling according to the invention, connections between individual drill rod elements and in particular a connection between a drill rod element and a drilling tool can be made and released efficiently and safely.

A preferred embodiment of the invention is that the locking bolt is mounted in a housing and that the resetting member protrudes from the housing and is mechanically actuable. The at least one housing for the at least one locking bolt is preferably attached here to an outer side of the sleeve-shaped coupling receptacle. This allows the drill rod coupling to be actuated in a simple manner from the outside. The locking recess is located here on the inner coupling member.

It is particularly advantageous here that the locking bolt is mounted in the housing so as to be rotatable about its bolt axis, that the resetting member extends transversely to the bolt axis and is formed as a lever for rotating the locking bolt, and that a slotted link mechanism is provided between the locking bolt and the housing, by means of which a rotary movement of the locking bolt can be converted into a movement radially to the drill rod axis. The locking bolt is cylindrical here and is inserted into a tubular housing and rotatably mounted therein. Connected to the locking bolt is a preferably lever-like resetting member, which projects outward compared to the housing. In this way, an axially directed force can be applied to the lever-like resetting member in a simple manner and is converted by the resetting member into a rotary movement of the locking bolt. This rotary movement can be converted into a radial positioning movement for unlocking the locking bolt via a slotted link mechanism. When the resetting force is cancelled, the locking bolt is then pressed back into its locking position by the tensioning device, wherein the resetting member is turned back into its starting position in accordance with the slotted link mechanism.

According to a development of the invention, a particularly robust embodiment is achieved in that the slotted link mechanism has an at least partially helical groove as a slotted link, in which a cam engages. Preferably, the slotted link in the form of a groove is formed at least on the inside of the housing, wherein in particular a cam in the form of a peg, which is arranged on the locking bolt, engages in the helical slotted link. In principle, however, the helical groove can also be formed on the outside of the locking bolt, while a corresponding cam in the form of a peg is attached to an inner wall of the housing.

According to a development of the invention, an alternative robust embodiment of the drill rod coupling results from the fact that the resetting member is provided with a tapered slide mechanism by means of which an axial movement can be converted into a radial movement of the locking bolt. The tapered slide mechanism can here be configured in a fundamentally arbitrary manner in order to effect a movement conversion by 90°. In particular, the tapered slide mechanism can here be arranged on the outside of the coupling device or inside the pin-shaped coupling member. The desired directional conversion of a movement can be effected by the arrangement of at least one actuating surface directed obliquely to the axis of the drill rod.

A particularly low-wear embodiment of a variant of the invention is achieved in that a contact element is arranged at a free end of the resetting member, which element is provided with a rounded contact surface. A rounded contact surface, which preferably comes into contact with a straight mating surface, can reduce friction. The rounded contact surface can preferably also be a rotatable element, such as a rotatable cam.

In principle, the drill rod coupling can be operated directly by an operator by hand. An efficient embodiment variant of the invention can be seen in the fact that an actuating drive, in particular a linear drive, is provided for applying the resetting force. The linear drive may in particular be a hydraulic or pneumatic actuating cylinder or an electrically operated spindle drive. In principle, a common actuating drive or a separate actuating drive can be arranged for each locking bolt. Preferably, the actuating drive can be controlled in a wired manner or wirelessly so that it can be easily operated by a machine operator, in particular from the machine cabin.

According to a development of the invention, a particularly compact embodiment is achieved in that the at least one locking bolt with the tensioning device is mounted in the pin-shaped coupling member. The pin-shaped coupling member is here formed hollow or with a receiving space for the at least one locking bolt and the tensioning device. In this arrangement, the locking recess is then arranged correspondingly on the sleeve-shaped coupling receptacle.

It is preferred here for a particularly efficient locking that two locking bolts are mounted opposite one another in the coupling member and that the tensioning device is arranged axially directed in the coupling member. This arrangement can in particular be combined with a tapered slide mechanism, wherein the tensioning device and, if applicable, a linear actuating drive are oriented longitudinally and preferably coaxially to the drill rod axis. In this arrangement in particular, transverse forces can compensate each other by means of two, preferably radially opposite locking bolts, so that a particularly stable arrangement is achieved.

Another advantageous embodiment variant is that the tensioning device has a spring-loaded pusher with a pushing surface inclined with respect to the drill rod axis and that the locking bolts, at their inner ends, have inclined actuating surfaces which rest against the pushing surfaces of the pusher. This achieves a tapered slide mechanism by which two or more radially directed locking bolts can be simultaneously pressed outward and can be held there. Correspondingly, a linear drive can actuate the same or an opposite pusher in order to retract the locking bolts into their unlocked position.

According to a further embodiment variant of the invention, it is preferred that the resetting member is a movable axial piston of the actuating drive. The resetting member can here be directly part of the actuating drive or be moved by the actuating drive.

For an efficient closing of the drill rod coupling by an axial insertion of the coupling member into the coupling receptacle, it is advantageous that the locking bolt has a chamfer on its free front side, so that the locking bolt can be pressed radially into its unlocking position during an axial coupling of coupling receptacle and coupling member. As soon as the locking recesses have reached the height of the locking bolts during this coupling process, the latter can move back into their locking position and thus into the locking recesses due to their spring pretension. This immediately achieves a secure coupling. The chamfer on the front side of the locking bolt serves here to convert the axial relative movement between the coupling member and the coupling receptacle into a radial resetting movement of the locking bolt.

Furthermore, it is preferred here that the locking bolt has a main body with, mounted displaceably thereon, a pawl on the free front side of which the chamfer is formed, and that a spring element is arranged between the main body and the pawl, so that the pawl of the locking bolt can be pressed radially into the unlocking position during an axial coupling of the coupling receptacle and the coupling member. The spring element can be formed with a lower tensioning force than the tensioning device, so that easy locking is made possible during an insertion process. For unlocking, the locking bolt as a whole with the main body and the pawl must be pulled back against the force of the tensioning device.

A further advantageous embodiment of the invention is that at least one unlocking spring is provided, by means of which the at least one locking bolt can be reset from its locking position into the unlocking position. Before locking the drill rod coupling, the at least one unlocking spring can be tensioned, so that after locking by the tensioning device, simple unlocking can also be effected again by the at least one unlocking spring. A corresponding release device can be provided for this purpose, which can be actuated manually or in a remotely controlled manner.

The invention further relates to a drilling device having a drill drive for driving in rotation a drill rod having drilling tool and a rotary table, wherein a drill rod coupling according to the invention is provided and the resetting member of the drill rod coupling can be actuated by the rotary table. In this case, the drill rod coupling does not have to be arranged on the drill drive. Rather, the drill rod coupling is arranged between the individual drill rod elements or between a drill rod element and the drilling tool. By axially moving the drill rods relative to the rotary table, which is formed in particular for screwing in drill rod pipes for cased drilling, a necessary axial relative movement in relation to the resetting member can be carried out directly by the drilling device without an additional actuating drive. In principle, further stops and arrangements for actuating the resetting member by an axial relative movement between the resetting member and an actuating member can also be provided on the drilling device.

With regard to the method, the invention is characterized in that the locking bolt is pressed into its locking position by the tensioning device with a predefined tensioning force and that when a resetting force is applied to the resetting member, the locking bolt is reset into the unlocking position in which the pin-shaped coupling member can be axially displaced relative to the sleeve-shaped coupling receptacle. The method is carried out here with the above-described drill rod coupling according to the invention. The advantages described above can be achieved here.

In particular, the method can be used to efficiently construct a drill rod from multiple drill rod elements, wherein one drill rod coupling is arranged between each drill rod element. It can also be efficiently attached and detached a drilling tool at the lower end of a drill rod.

Figure 2:
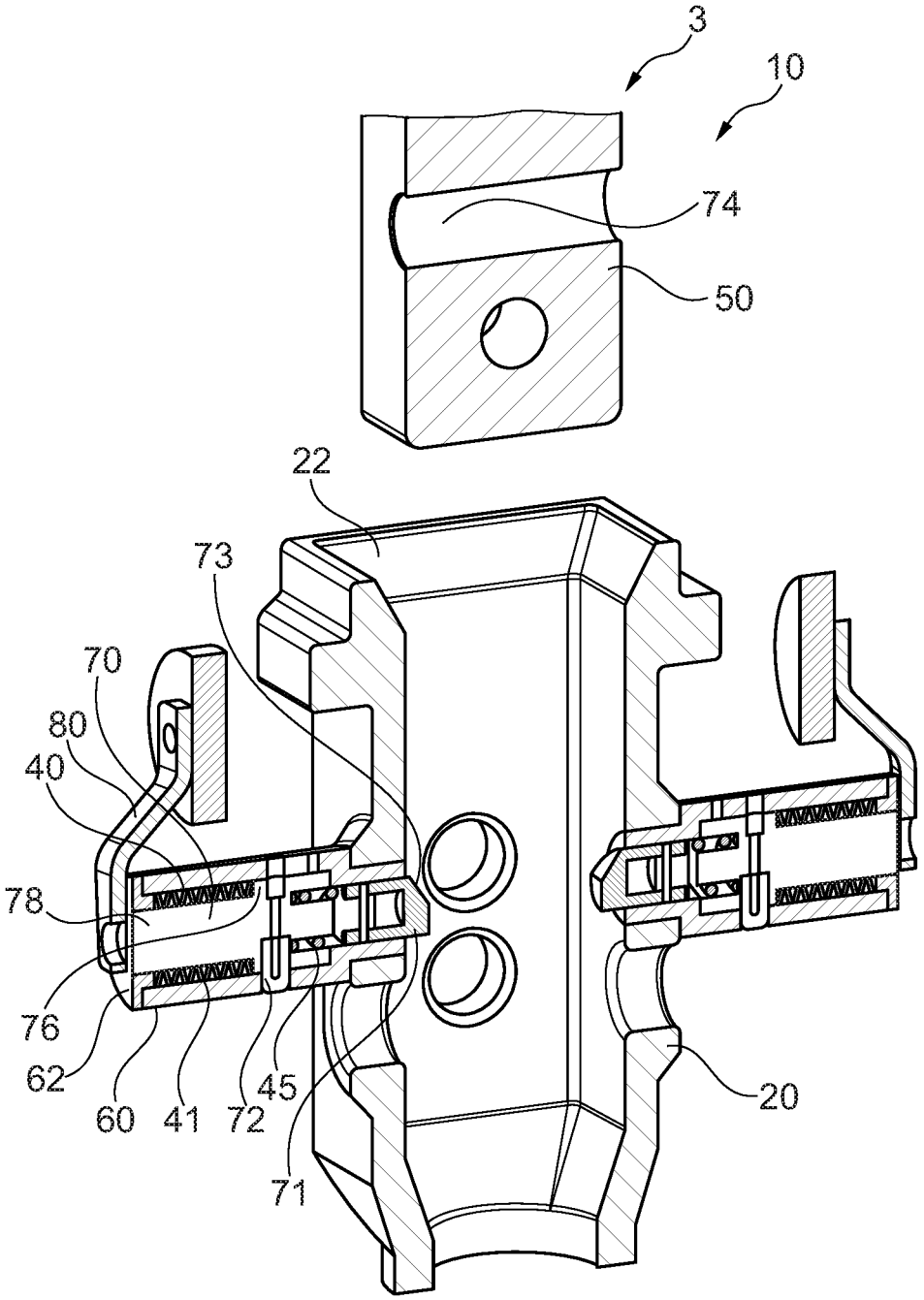
Figure 3:
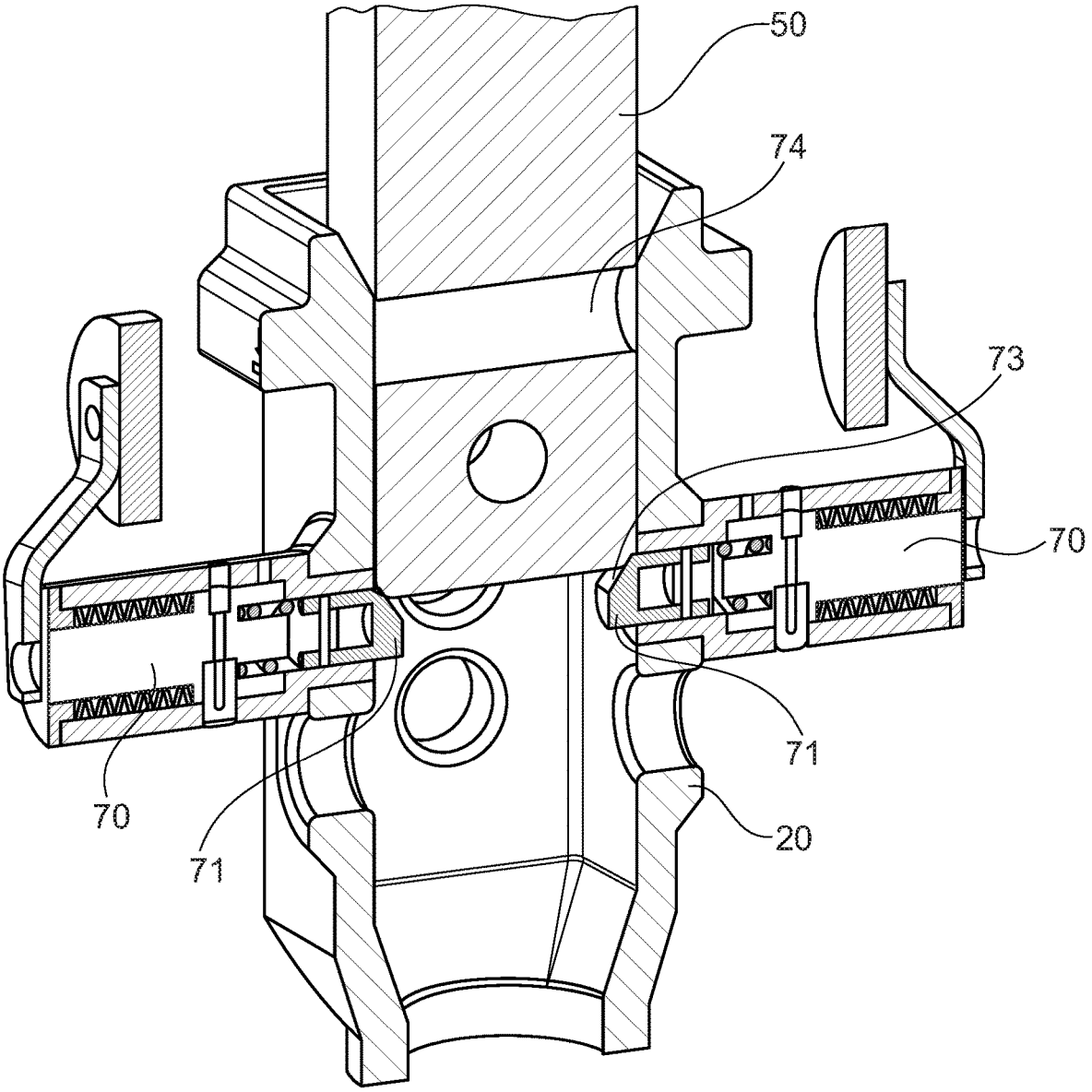
Figure 4:
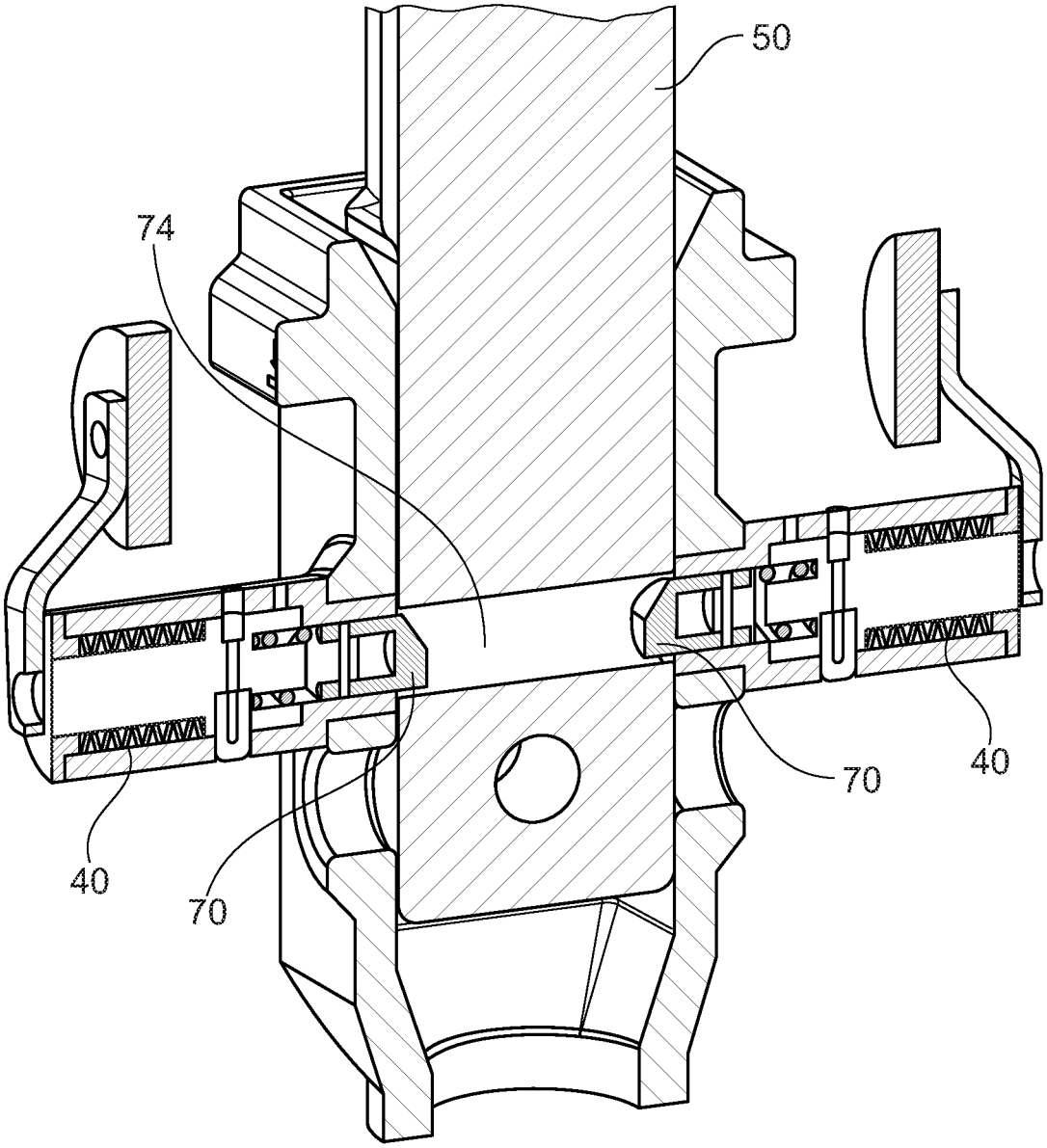
Figure 5:
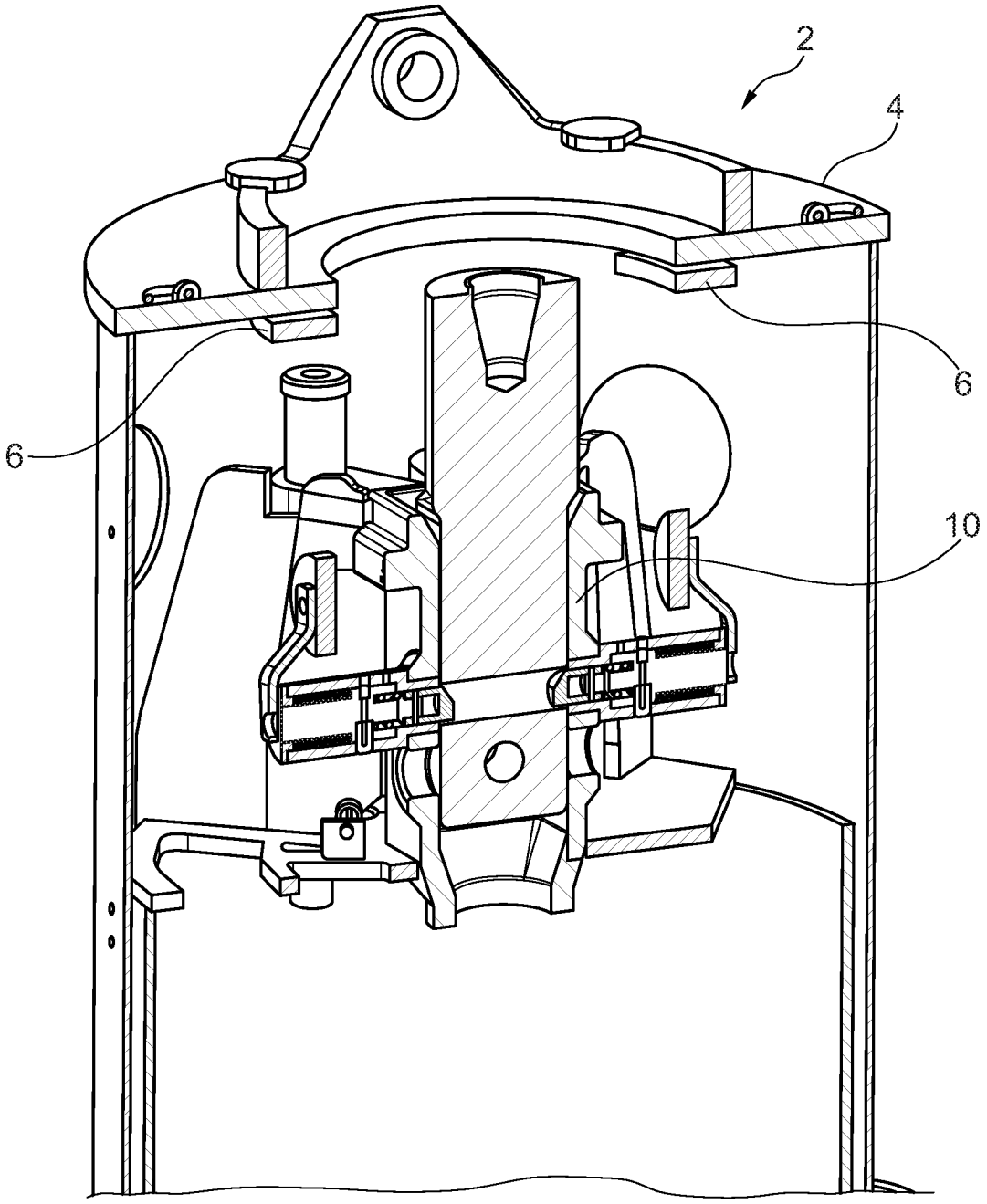
Figure 6:
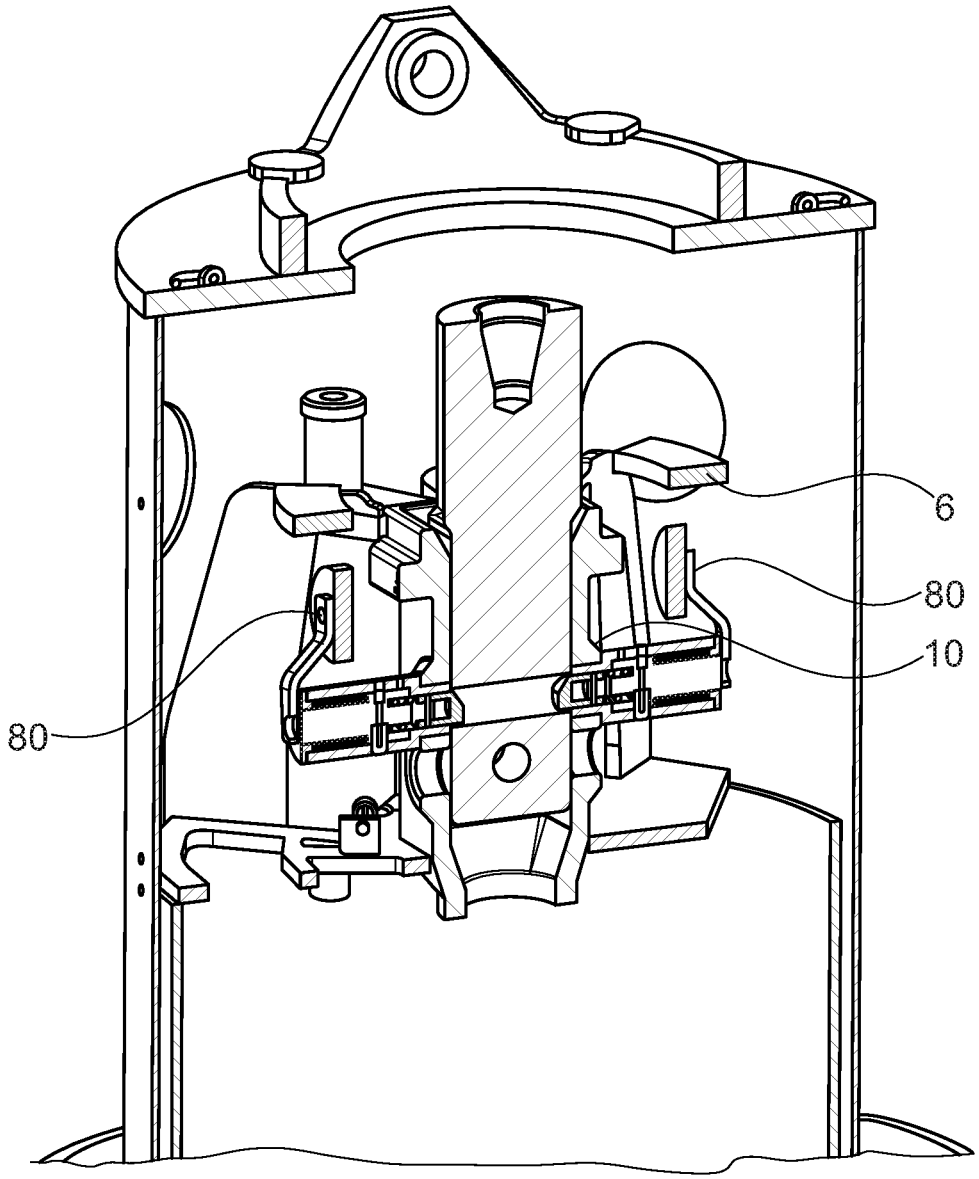
Figure 7:
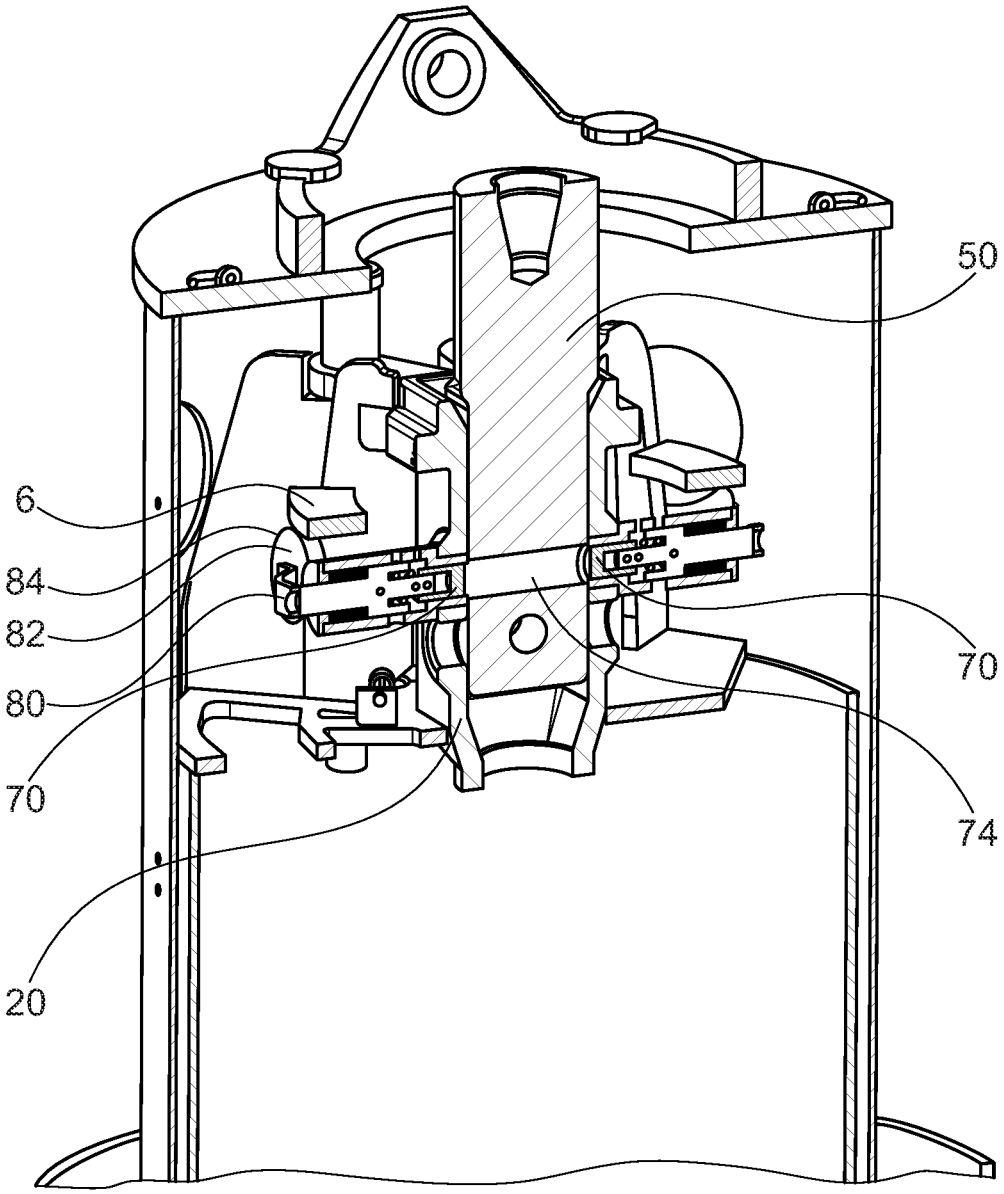
Figure 8:
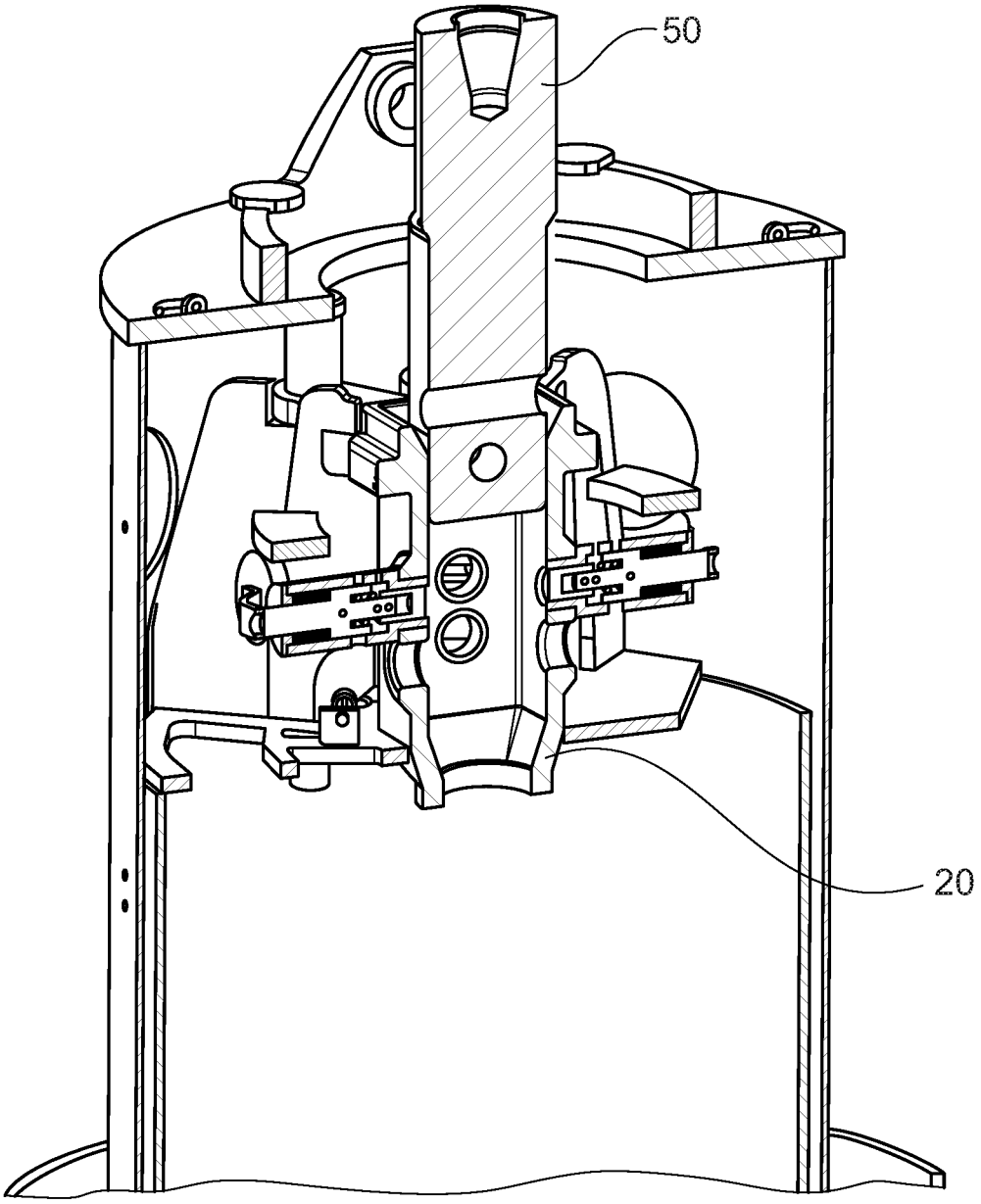
Figure 9:
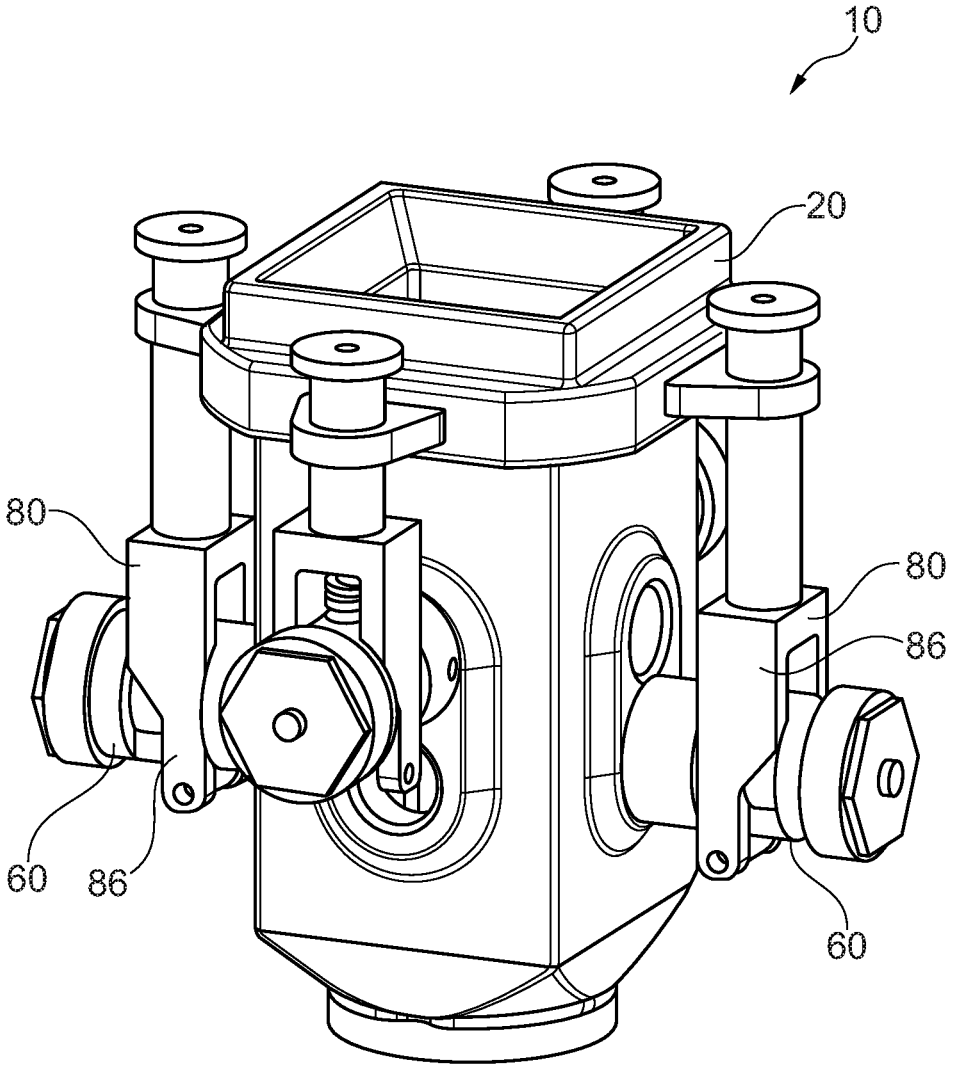
Figure 10:
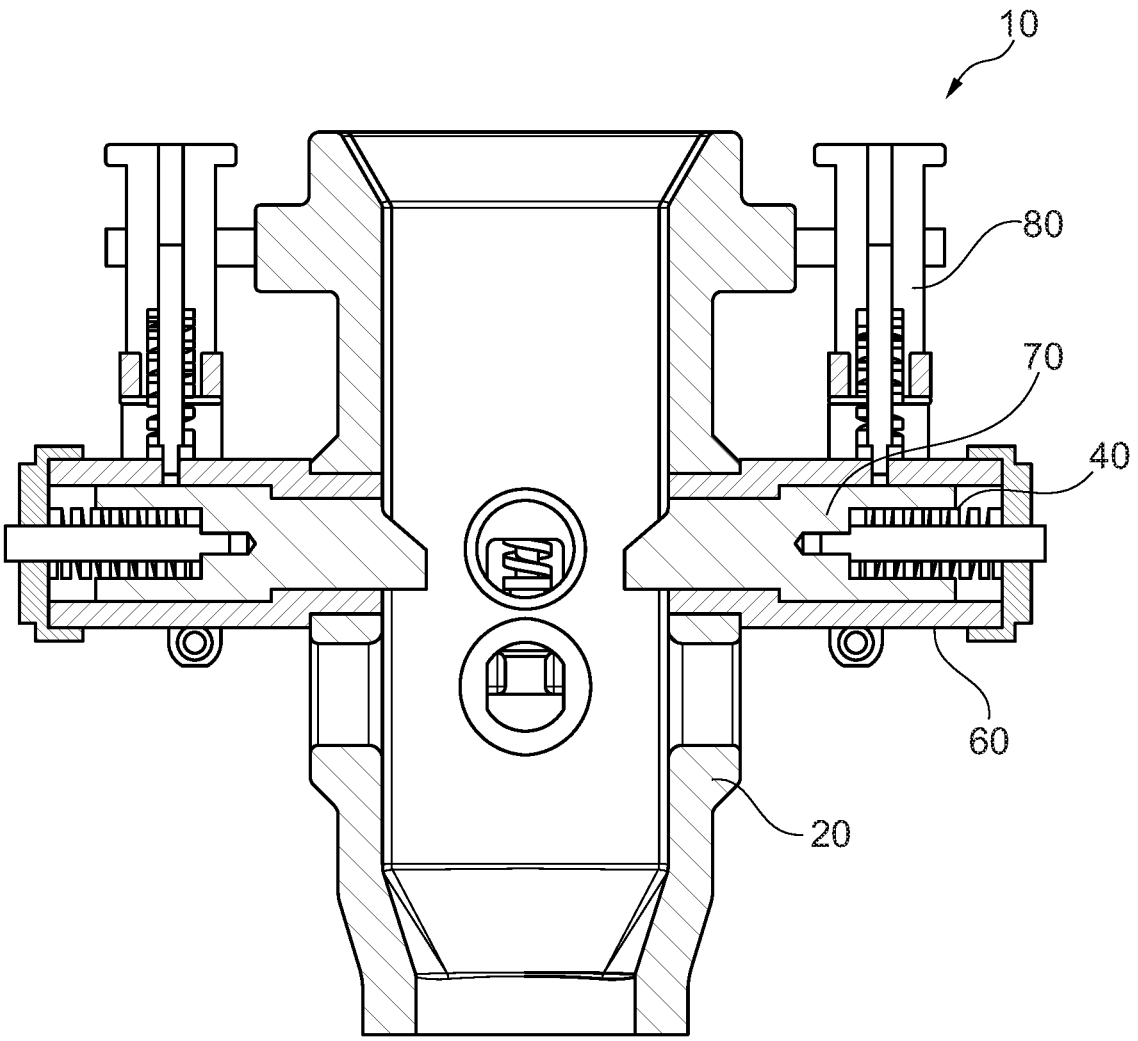
Figure 11:
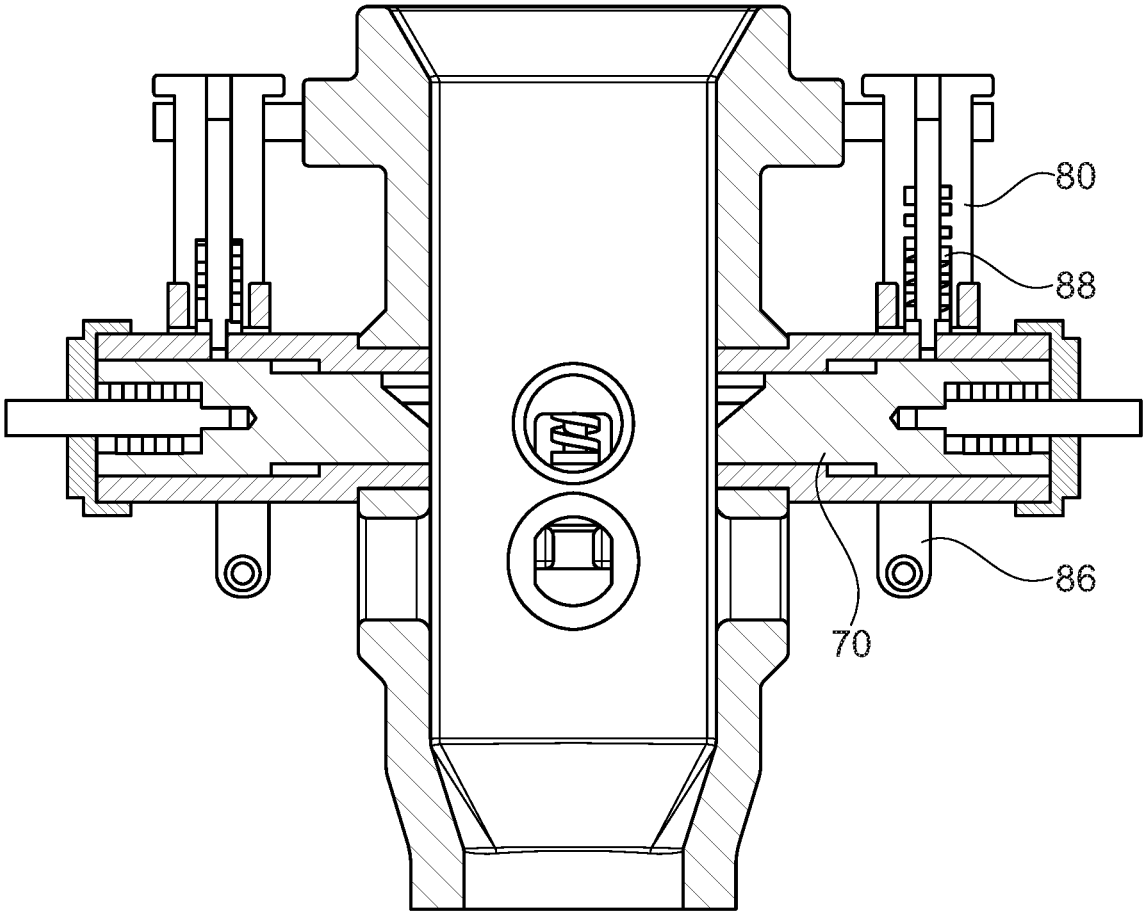
Figure 12:
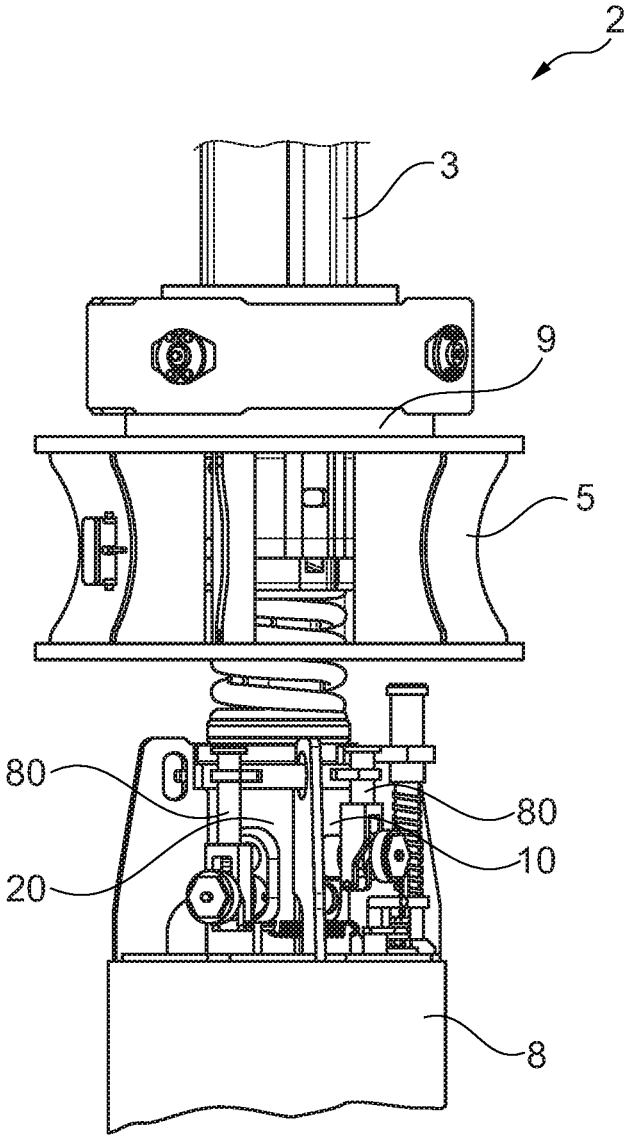
Figure 13:
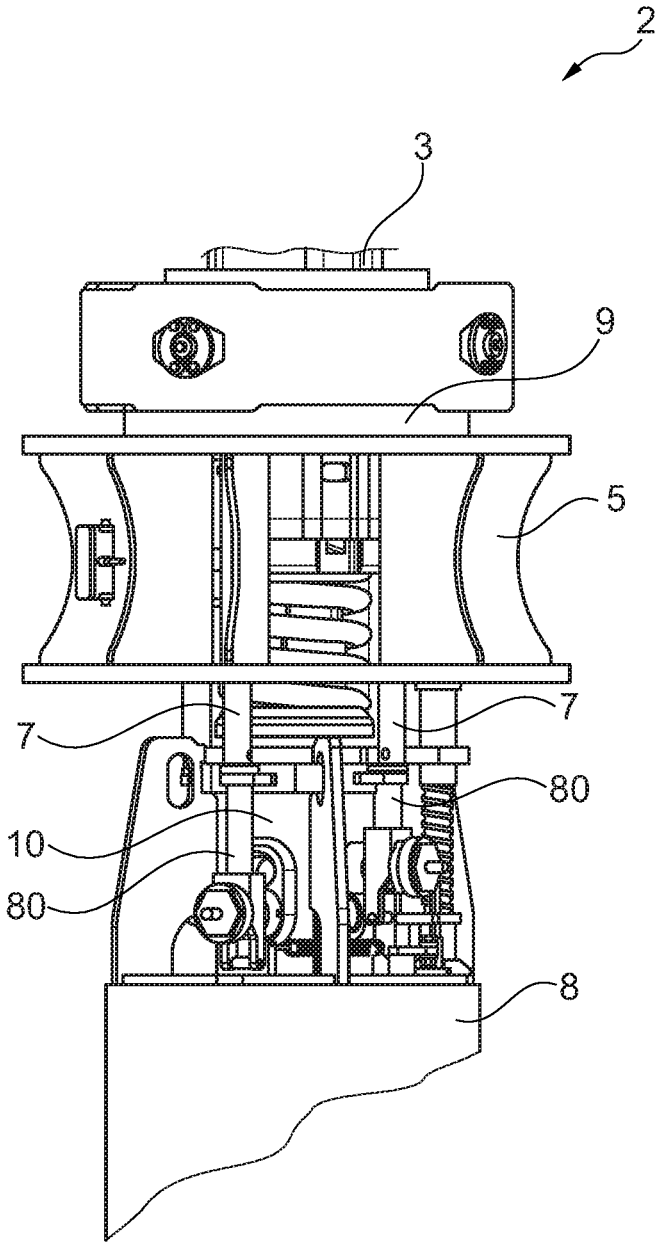
Figure 14:
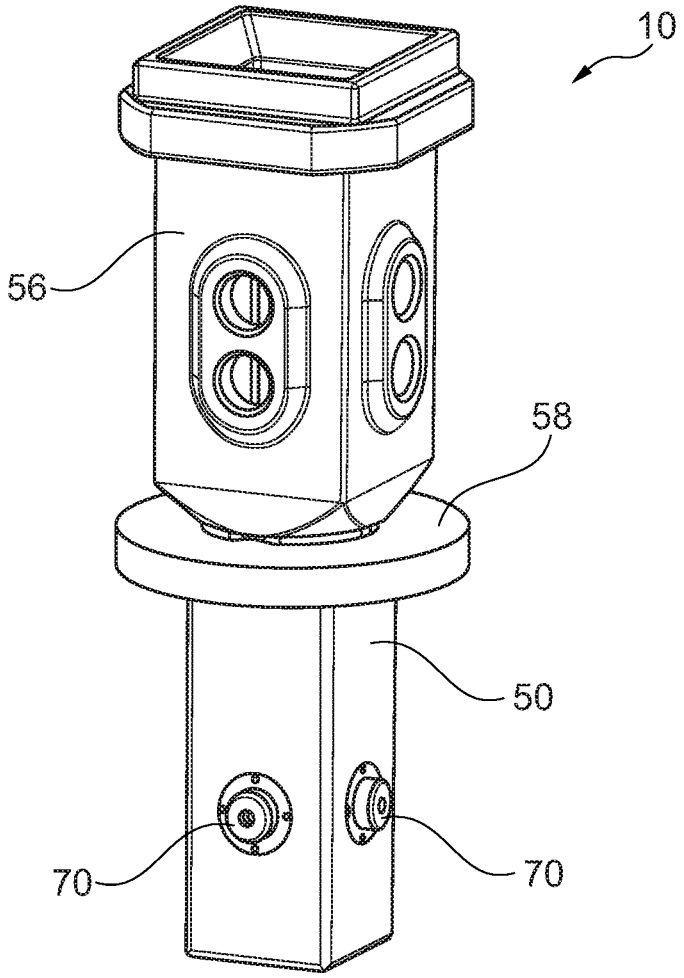
Figure 15:
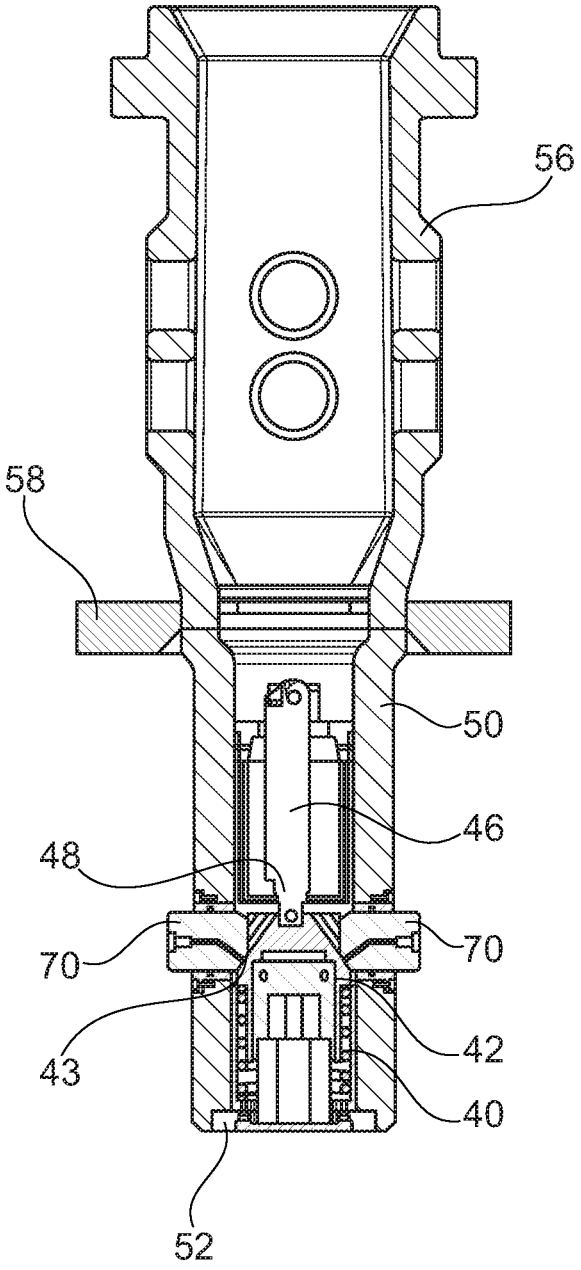
Figure 16:
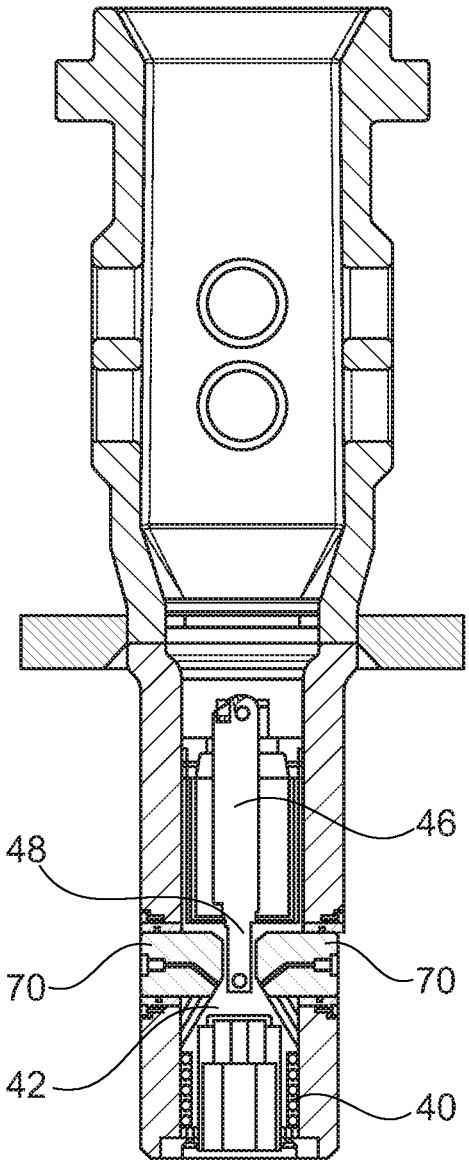
Figure 19:
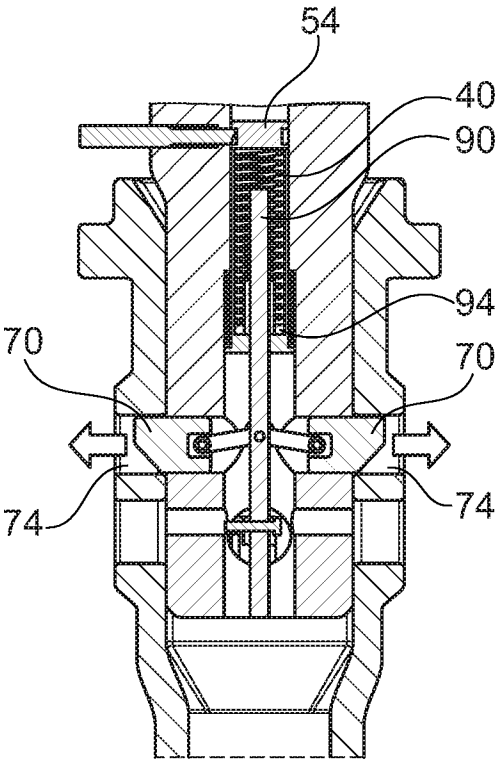
Figure 18:
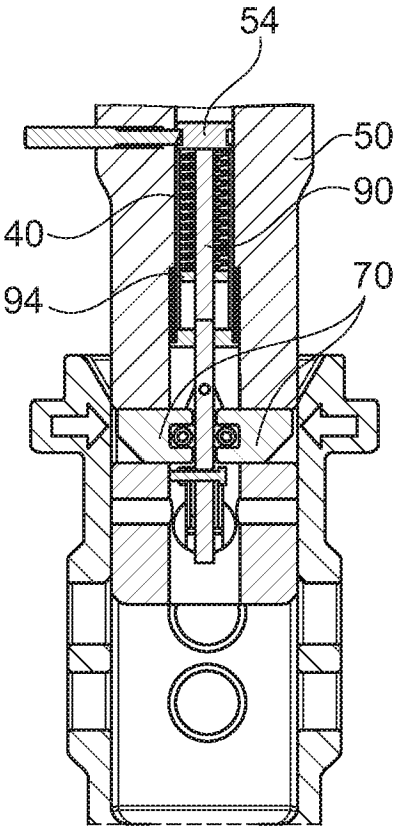
Figure 17:
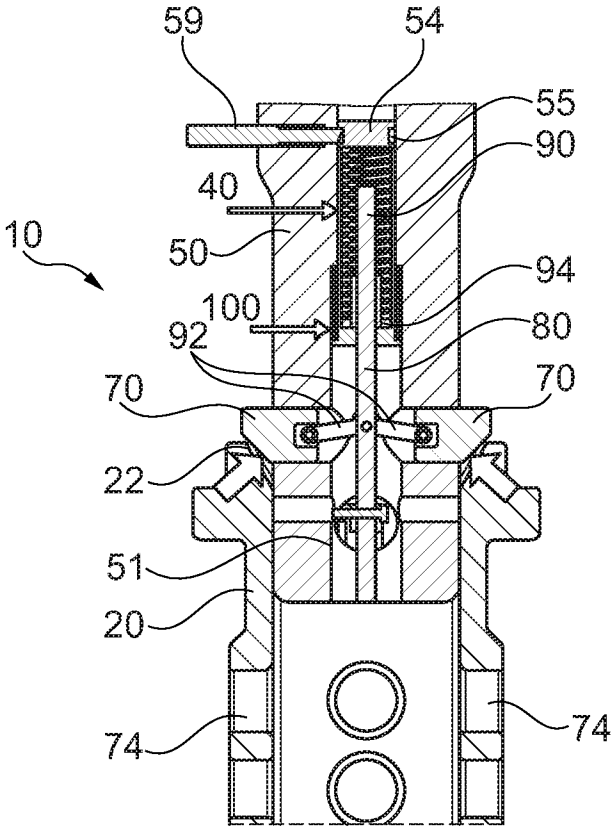
Figure 22:
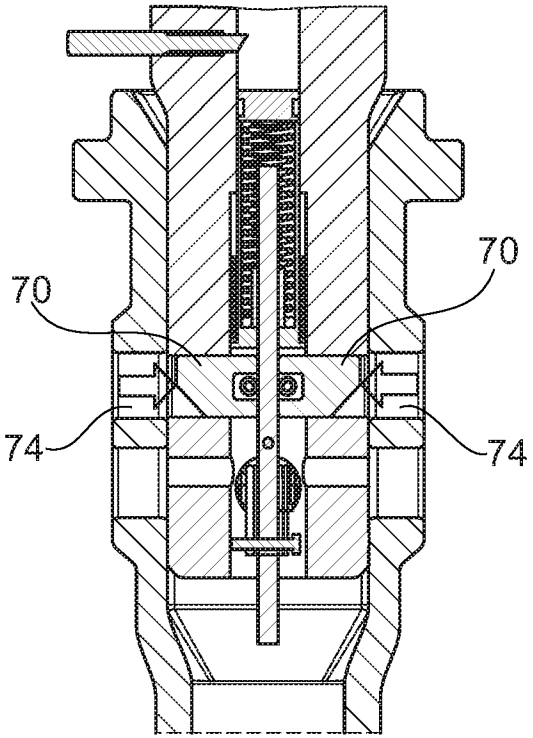
Figure 21:
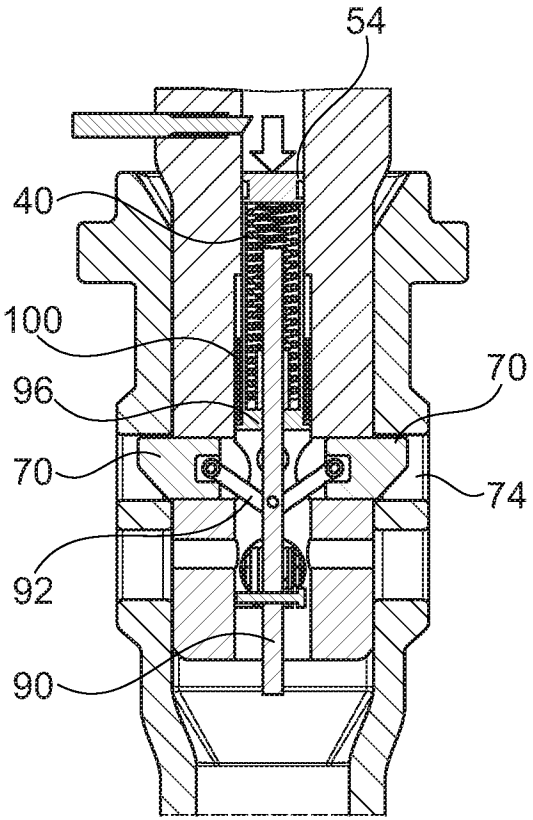
Figure 20:
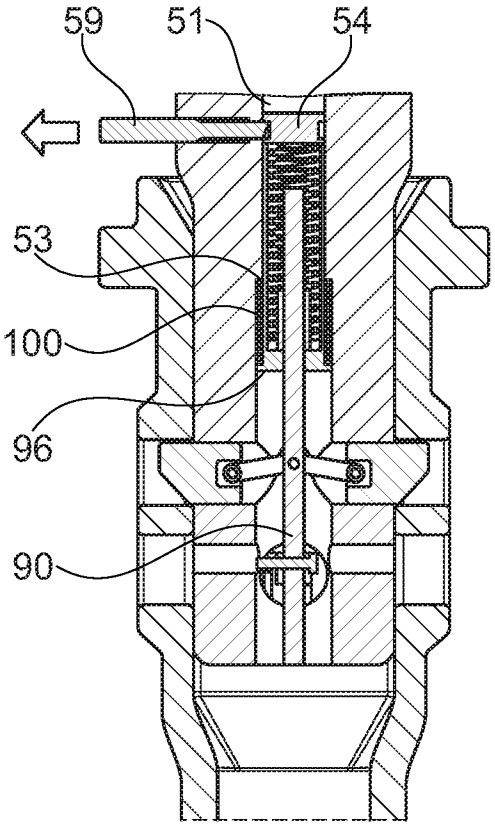
Figure 26:
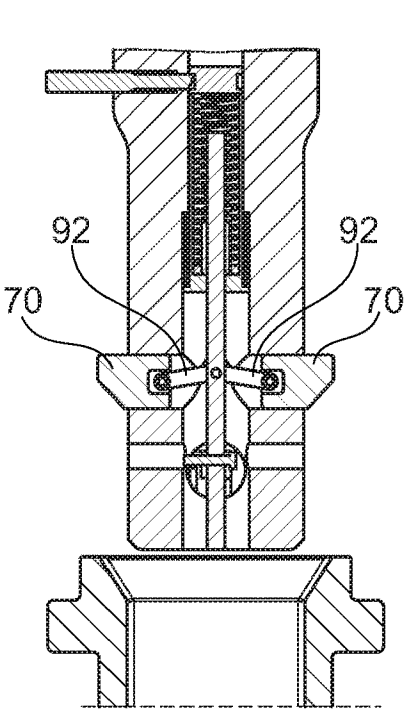
Figure 25:
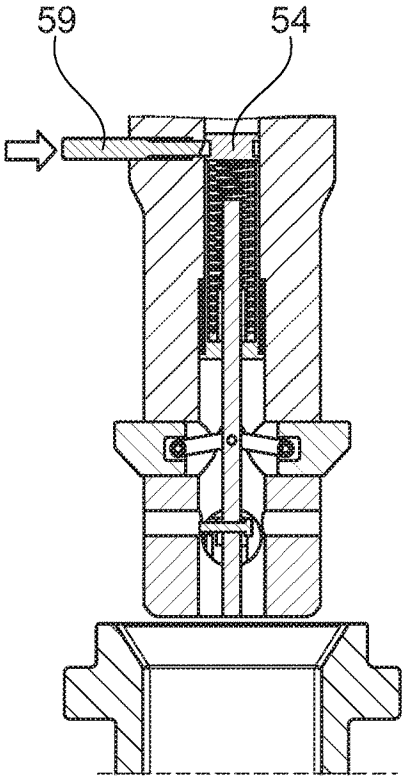
Figure 24:
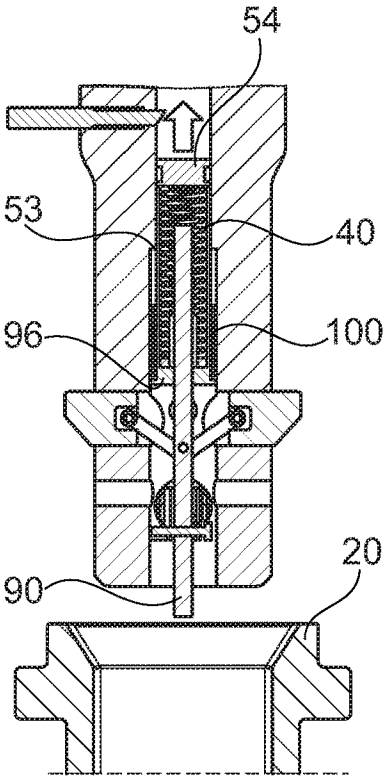

The invention is further described with reference to preferred exemplary embodiments, which are shown schematically in the drawings. The drawings show:

FIG. 1 a perspective illustration of a sleeve-shaped coupling receptacle of a first drill rod coupling according to the invention;

FIG. 2 a cross-sectional view of the coupling receptacle from FIG. 1 with a coupling member to be inserted;

FIG. 3 a cross-sectional view of the drill rod coupling during insertion of the coupling member;

FIG. 4 a cross-sectional view of the drill rod coupling from FIGS. 1 to 3 with the coupling member locked;

FIG. 5 a partial cross-sectional view through a drilling device with the locked drill rod coupling according to FIG. 4;

FIG. 6 a cross-sectional view of the drilling device according to FIG. 5 when releasing the drill rod coupling;

FIG. 7 the drilling device of FIGS. 5 and 6 with the coupling member unlocked;

FIG. 8 a cross-sectional view of the drill rod coupling according to FIGS. 5 to 7 when the unlocked coupling member is pulled out of the coupling receptacle;

FIG. 9 a perspective view of a further drill rod coupling according to the invention;

FIG. 10 a cross-sectional view of the drill rod coupling from FIG. 9 with locking bolt in locking position;

FIG. 11 a cross-sectional view corresponding to FIG. 10 of the drill rod coupling with locking bolt in unlocked position;

FIG. 12 a partial side view of a drilling device with the drill rod coupling according to FIGS. 9 to 11 before unlocking;

FIG. 13 a partial side view of a drilling device according to FIG. 12 during unlocking;

FIG. 14 a perspective view of a coupling member of a further drill rod coupling according to the invention;

FIG. 15 a cross-sectional view of the coupling member from FIG. 14;

FIG. 16 a cross-sectional view of the drill rod element of FIGS. 14 and 15 with the locking bolt retracted, FIG. 17-19 cross-sectional views of a further drill rod coupling according to the invention during locking;

FIG. 20-22 cross-sectional views of the drill rod coupling of FIGS. 17 to 19 during unlocking; and FIG. 23-26 cross-sectional views of the drill rod coupling according to FIGS. 17 to 22 during tensioning of an unlocking spring.

FIG. 1 shows a sleeve-shaped coupling receptacle 20 of a first drill rod coupling 10 according to the invention. The sleeve-shaped coupling receptacle 20 is formed cuboidel, corresponding to a so-called Kelly box, with an upper insertion opening 22 and side openings 26 for the passage of a locking bolt. An annular connection region 24 is provided on the underside of the coupling receptacle 20 and is fixedly connected to a drilling tool (not shown).

Mounted on two opposite side walls of the coupling receptacle 20 are cylindrical housings 60, in which locking bolts 70 are radially displaceably mounted, as is clearly shown in FIG. 2. At their outer end, which extends in a radial direction to a longitudinal axis of the drill rod, a lever-like resetting member 80 is attached to each locking bolt 70. A circular disc-shaped contact element 82 with a rounded contact surface 84 is arranged at the outer end of the resetting member 80.

As will be explained in greater detail below, the resetting member 80 can be pivoted by approximately 90° from the vertically oriented position shown to a horizontal position, wherein the locking bolt 70 is rotated in the housing 60 accordingly. In the housing 60 there is provided a partially helical groove 66, into which there projects a cam 72 which is in the form of a peg and is fixedly connected to the locking bar 70. This forms, on the whole, a slotted link mechanism 64 which converts a rotary movement of the resetting member 80 into a radial linear movement of the locking bolt 70. In this way, the locking bolt 70 can be retracted from its locking position shown in FIG. 2, in which a front end of the locking bolt 70 projects into the angular receiving space of the sleeve-shaped coupling receptacle 20, into a radially retracted unlocking position, in which the locking bolt 70 no longer projects into the inner receiving space of the sleeve-shaped coupling receptacle 20.

As shown in more detail in FIG. 2, a tensioning device 40 is arranged inside the housing 60 and in the present exemplary embodiment is formed by an arrangement of disc springs 41. Here, the tensioning device 40 is supported on the one hand by a housing cover 62 of the housing 60 and on the other hand by an annular shoulder 76 of the locking bolt 70. A main body 78 of the locking bolt 70 is hereby pressed into a locking position. A pawl 71 is slidably mounted on the radially inner end of the main body 78 of the locking bolt 70 and is pressed radially inward into the locking position by a spring element 45, which is shown in FIG. 2. On its front side, the pawl 71 has an actuating surface 73 that is chamfered toward the insertion opening 22.

Via the insertion opening 22, an angular coupling member 50, which is attached to the lower end of a drill rod element 3 (not shown further), for example a so-called Kelly bar, can be inserted into the inner receiving space of the sleeve-shaped coupling receptacle 20 with a transversely directed locking recess 74 for locking the drill rod coupling 10.

As can be clearly seen in FIG. 3, a chamfer at the front end of the coupling member 50 comes here into contact with the chamfered actuating surface 73 on the pawls 71 of the opposite locking bolts 70. By further axial insertion of the coupling member 50, the pawls 71 can thus be pressed radially outward into their unlocked position against the force of the spring elements 45 by this insertion movement of the coupling member 50 alone, until the transversely directed locking recess 74 comes to rest at the level of the opposite pawls 71.

As clearly shown in FIG. 4, in this state the pawls 71 can be pressed back into their locking position by the force of their respective spring elements 45, wherein the pawls 71 project into the locking recess 74. In this state according to FIG. 4, the pin-shaped coupling member 50 is form-lockingly locked in the sleeve-shaped coupling receptacle 20. In this state of the drill rod coupling 10, both a torque and axial forces can thus be transmitted between the pin-shaped coupling member 50 and the sleeve-shaped coupling receptacle 20 via the drill rod coupling 10. The pin-shaped coupler pocket 50 is preferably attached here to a lower end of a drill rod element.

A release or unlocking of the described drill rod coupling 10 is explained in more detail below with reference to FIGS. 5 to 8.

The drill rod coupling 10 can be unlocked at a drilling device 2, which is only partially shown, by a so-called rotary table 4. The rotary table 4 represents a sleeve-shaped drive part, which is known in principle, which can be provided on the drilling device 2 for the rotary driving of so-called support pipes for cased drilling. According to the invention, one or more actuating plates 6 are arranged axially adjustably within such a rotary table 4. Axial adjustment can be effected by means of a linear drive, which is not shown here.

Starting from an upper retracted position as shown in FIG. 5, the two actuating plates 6 shown can be moved downward relative to the resetting members 80 on the drill rod coupling 10, as indicated in FIG. 6.

In the process, the actuating plates 6 come into contact with the contact elements 82 at the free end of the lever-like resetting members 80, wherein, due to the rounded contact surface 84, the resetting members 80 are pivoted from their vertical position to an approximately horizontal position through approximately 90°, as can be clearly seen in FIG. 7. Due to the above-described slotted link mechanism 64 according to FIG. 1, each locking bolt 70 together with its pawl 71 can be radially retracted from the locking position in the locking recess 74 of the pin-shaped coupling member 50 into an unlocking position by this rotating or pivoting movement of the resetting members 80. In the process, the locking pawls 71 of the locking bolts 70 leave the transversely directed locking recess 74 so that the pin-shaped coupling member 50 can be pulled axially out of the sleeve-shaped coupling receptacle 20, as is clearly shown in FIG. 8.

With the axial upward movement of the drill rod element 3 with the coupling member 50, the actuating plates 6 also move upward. Now, the locking bolts 70 are pressed inward again into their locking position via the tensioning device 40, wherein the resetting members 80 rotate back into the vertical starting position via the slotted link mechanism 64.

An alternative drill rod coupling 10 is shown in FIGS. 9 to 13. The pin-shaped coupling member 50, which is not shown in more detail, corresponds to the above-described coupling member 50.

The coupling receptacle 20 is also formed substantially in accordance with the coupling receptacle 20 described above. In deviation from the above-described exemplary embodiment according to FIGS. 1 to 8, the housing 60 with the locking bolt 70 as well as the resetting member 80 have a different design.

The resetting member 80 is formed as an exclusively axially movable lever with a slotted link fork 86. The resetting member 80 is mounted so that it can be moved axially between an upper position, which is shown in FIGS. 9 and 10, and a lower position as shown in FIG. 11. In the upper position, the resetting member 80 is not in direct operative connection with the locking bolt 70 in the housing 60, so that the locking bolt 70 is pressed into its inwardly projecting locking position by a tensioning device 40 formed by springs, as can be seen clearly in FIG. 10.

By pressing the resetting members 80 downward into their respective lower position as shown in FIG. 11, the locking bolt 70 is radially retracted into the unlocking position by the slotted link fork 86 with a stepped actuating surface in accordance with a slotted link mechanism (not shown in more detail), which is clearly shown in FIG. 11. After the axial pressure on the resetting members 80 has been cancelled, they are pushed back into their upper position by a return spring 88. The tensioning device 40 moves the locking bolt 70 back into the locking position. In principle, other slotted link mechanisms can also be provided which convert an axial actuating movement on the resetting members 80 into a radial retraction movement of the locking bolts 70.

FIGS. 12 and 13 show a drilling device 2 with which the drill rod coupling 10 can be actuated according to FIGS. 9 to 11. A drilling bucket, which is only partially shown, is detachably attached as a drilling tool 8 to a drill rod element 3 by means of the drill rod coupling 10. The drill rod element 3 projects through a rotary drive 9, also called a power rotary head. An opening plate 5 is arranged on the rotary drive 9 and is axially spaced from the resetting members 80 in FIG. 12.

By moving actuating bolts 7 on the opening plate 5 downward and by moving the rotary device 3 and thus the opening plate 5 and drilling tool 8 axially toward each other, as shown in FIG. 13, the resetting members 80 are pressed downward. This unlocks the drill rod coupling 10 and the drilling tool 8 can be removed from the drill rod element 3.

A further drill rod coupling 10 according to the invention will be explained in conjunction with FIGS. 14 to 16.

In this embodiment, the locking bolts 70 are housed in the pin-shaped coupling member 50. In the illustrated exemplary embodiment according to FIG. 14, the pin-shaped coupling member 50 has an adapter sleeve 56 corresponding to a Kelly box, so that the pin-shaped coupling member 50 can be attached to a conventional drill rod element with a square connection. A circular disc-shaped stop plate 58 can be arranged between the adapter sleeve 56 and the actual pin-shaped coupling member 50 and by which can be achieved a defined axial position during insertion into a sleeve-shaped coupling receptacle. The sleeve-shaped coupling receptacle can be formed here according to a conventional Kelly box. Of course, the pin-shaped coupling member 50 can also be attached directly to a drill rod element 3, for example a so-called Kelly bar.

As can be seen from FIG. 15, the coupling member 50 has an inner cavity in which a tensioning device 40, which is formed by a spring, is arranged. The tensioning device 40 is supported at the bottom at a base plate 52 of the coupling member 50 and at the top at a shoulder of a conical pusher 42. The compressive force of the tensioning device 40 pushes the conical pusher 42 upward into an upper position. Two opposing locking bolts 70 with obliquely oriented pushing surfaces 43 abut the conical surface of the pusher 42. The locking bolts 70 can be slidably coupled to the conical pusher 42 via tongue-and-groove connections, not shown in more detail.

In the upper position of the pusher 42 according to FIG. 15, the locking bolts 70 are thus pressed radially outward into their locking position by the tensioning device 40. For unlocking and thus radially retracting the locking bolts 70, an overhead linear drive is arranged as an actuating drive 46 with an extendable axial piston 48. The actuating drive 46 can in particular be a hydraulic cylinder.

For unlocking, the axial piston 48 can be extended downward by the actuating drive 46, wherein the pusher 42 is pressed downward by the axial piston 48 against the force of the tensioning device 40. In the process, the locking bolts 70 held on the pusher 42 are retracted radially into their unlocking position, in which they are located within the pin-shaped coupling member 50, as is clearly shown in FIG. 16. When the actuating drive 46 is retracted, the axial piston 48 is pushed upward again by the pusher 42 and the tensioning device 40. At the same time, the locking bolts 70 here are moved radially outward again into their locking position, so that fail-safe operation is ensured even if the linear drive 46 fails in the locking position, i.e. in the operating position.

A further embodiment of a drill rod coupling 10 according to the invention with a sleeve-shaped coupling receptacle 20 and a pin-shaped coupling member 50 is shown in FIGS. 17 to 26. Similarly to the preceding exemplary embodiment according to FIGS. 14 to 19, two transversely directed locking bolts 70 are displaceably mounted in a coupling member 50. The coupling member 50 has a central longitudinal channel 51, in which a push rod 90 is arranged as a resetting member 80, which is hingedly connected to the two locking bolts 70 via articulated levers 92. A tensioning device 40 in the form of a helical spring is arranged inside the longitudinal channel 51 and is supported at its upper side on a supporting disc 54 in the longitudinal channel 51. The supporting disc 54 is fundamentally displaceably mounted in the longitudinal channel 51, wherein the supporting disc 54 has a side recess 55 on its outer side. A transversely directed locking pin 59 engages in this side recess 55 and is movably mounted on the coupling member 50. In the locking position shown in FIG. 17, the locking pin 59 engages in the side recess 55, wherein the supporting disc 54 is fixed in its position.

Furthermore, the tensioning device 40 is supported downward on a first radial shoulder 94, which is formed fixedly on the push rod 90.

Due to the inclined surfaces on the locking bolts 70 and the insertion opening 22 of the coupling receptacle 20, the locking bolts 70 are moved radially inward into the coupling member 50 when the coupling member 50 is inserted axially, as is clearly shown in FIG. 18. In the process, the articulated levers 92 move the push rod 90 with the first radial shoulder 94 upward. This compresses and tensions the coil spring of the tensioning device 40.

As soon as the locking bolts 70 are in line with the locking recesses 74 on the coupling receptacle 20 when the coupling member 50 is inserted, the locking bolts 70 are pressed radially outward into the locking recesses 74 by the tensioning device 40. In the process, the tensioning device 40 pushes the push rod 90 downward with the first radial shoulder 94, wherein the articulated levers 92 press the locking bolts 70 radially outward, as shown in FIG. 19.

For unlocking, the locking pin 59 is pulled radially outward, as shown clearly in FIG. 20. This removes the positional fixation of the supporting disc 54 in the longitudinal channel 51. In this state, an unlocking spring 100, which is supported on the one hand on an annular shoulder 53 on the longitudinal channel 51 and on the other hand on a driver disc 96 on the push rod 90 and is in a tensioned state according to FIGS. 17 to 20, can now trigger a downward movement of the push rod 90. Here, the unlocking spring 100 presses the driver disc 96 downward on the push rod 90, as shown clearly in FIG. 21. Together with the push rod 90 moves the tensioning device 40 attached thereto with the supporting disc 54 downward. By means of the articulated levers 92, pushing the push rod 90 downward causes the locking bolts 70 to be retracted radially from the locking recesses 74 of the sleeve-shaped coupling receptacle 20. In this way, the spring force of the unlocking spring 100 can achieve an unlocked state, which is shown in FIG. 22. In this unlocked state, the coupling member 50 can now be withdrawn axially from the coupling receptacle 20, as shown in FIG. 23.

Figure 23:
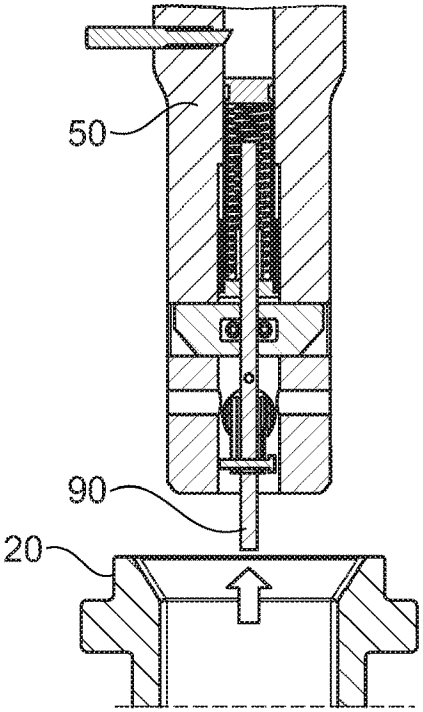

Before a new locking process, the unlocking spring 100 must be returned from its relaxed position as shown in FIGS. 22 and 23 into its tensioned actuation state. For this purpose, the actuating rod 70, which projects axially out of the coupling member 50 in the relaxed state of the unlocking spring 100, is pushed back again into the coupling member 50. This can be done, for example, by placing the coupling member 50 with the protruding push rod 90 on the outer edge of the coupling receptacle 20 and thereby pushing the push rod 90 back into the coupling member 50, as clearly illustrated in FIGS. 24 and 25.

The upward movement of the push rod 90 also pushes the driver disc 96 upward, wherein the unlocking spring 100 is pressed against the annular shoulder 53 and thus is tensioned again. At the same time, the tensioning device 40 with the supporting disc 54 attached to it is pushed upward again into its initial position. In this initial position, the supporting disc 54 can again be fixed in its position by pushing the locking pin 59 radially inward. By moving the push rod 90 upward, the locking bolts 70 are also reset into their radially outwardly projecting initial position by the articulated levers 92, as is clearly shown in FIG. 26. In this state according to FIG. 26, a new locking process can now take place according to FIG. 17.

The invention claimed is:

1. Drill rod element or drilling tool having a drill rod coupling, wherein the drill rod coupling is provided with a sleeve shaped coupling receptacle, which is arranged on a first drill rod element or drilling tool, a pin shaped coupling member which can be inserted axially into the coupling receptacle to form a torque proof connection for conjoint rotation, and which is arranged on a second drill rod element or drilling tool, and at least one locking bolt which is directed transversely to the axial coupling direction and extends, in a locked coupling position, between the coupling receptacle and the coupling member into a locking recess, wherein the locking bolt is mounted so as to be radially adjustable between an unlocking position and a locking position, characterized in that the drill rod coupling can be used for coupling between the individual drill rod elements, or between a drill rod element and the drilling tool, that a tensioning device is provided by means of which the locking bolt is pressed into its locking position with a predefined tensioning force, and that the locking bolt is connected to a resetting member by means of which the locking bolt can be reset into the unlocking position when a resetting force is applied.

2. Drill rod element or drilling tool having a drill rod coupling according to claim 1, characterized in that the locking bolt is mounted in a housing, and in that the resetting member protrudes from the housing and is mechanically actuable.

3. Drill rod element or drilling tool having a drill rod coupling according to claim 2, characterized in that the locking bolt is mounted in the housing so as to be rotatable about its bolt axis, in that the resetting member extends transversely to the bolt axis and is formed as a lever for rotating the locking bolt, and in that a slotted link mechanism is provided between the locking bolt and the housing, by means of which a rotary movement of the locking bolt can be converted into a movement radially to the drill rod axis.

4. Drill rod element or drilling tool having a drill rod coupling according to claim 3, characterized in that the slotted link mechanism has an at least partially helical groove as a slotted link, in which a cam engages.

5. Drill rod element or drilling tool having a drill rod coupling according to claim 1, characterized in that the resetting member is provided with a tapered slide mechanism by means of which an axial movement can be converted into a radial movement of the locking bolt.

6. Drill rod element or drilling tool having a drill rod coupling according to claim 1, characterized in that a contact element is arranged at a free end of the resetting member which member is provided with a rounded contact surface.

7. Drill rod element or drilling tool having a drill rod coupling according to claim 1, characterized in that an actuating drive, in particular a linear drive, is provided for applying the resetting force.

8. Drill rod element or drilling tool having a drill rod coupling according to claim 1, characterized in that the at least one locking bolt with the tensioning device is mounted in the pin shaped coupling member.

9. Drill rod element or drilling tool having a drill rod coupling according to claim 8, characterized in that two locking bolts are mounted opposite one another in the coupling member, and in that the tensioning device is arranged axially directed in the coupling member.

10. Drill rod element or drilling tool having a drill rod coupling according to claim 9, characterized in that the tensioning device has a spring loaded pusher with a pushing surface inclined with respect to the drill rod axis, and in that the locking bolts have, at their radially inner ends, inclined actuating surfaces which rest against the pushing surface of the pusher.

11. Drill rod element or drilling tool having a drill rod coupling according to claim 1, characterized in that the resetting member is a movable axial piston of the actuating drive.

12. Drill rod element or drilling tool having a drill rod coupling according to claim 1, characterized in that the locking bolt has a chamfer on its free front side, so that the locking bolt can be pressed radially into its unlocking position during an axial coupling of the coupling receptacle and coupling member.

13. Drill rod element or drilling tool having a drill rod coupling according to claim 12, characterized in that the locking bolt has a main body with, mounted displaceably thereon, a pawl on the free front side of which the chamfer is formed, and in that a spring element is arranged between the main body and the pawl, so that the pawl of the locking bolt can be pressed radially into the unlocking position during an axial coupling of the coupling receptacle and the coupling member.

14. Drill rod element or drilling tool having a drill rod coupling according to claim 1, characterized in that at least one unlocking spring is provided, by means of which the at least one locking bolt can be reset from its locking position into the unlocking position.

15. Drilling device, comprising a drill drive for driving in rotation a drill rod having a drilling tool and a rotary table, wherein a drill rod element or drilling tool having a drill rod coupling according to claim 1 is provided, characterized in that the resetting member of the drill rod coupling can be actuated by the rotary table.

16. Method for actuating a drill rod element or drilling tool having a drill rod coupling according to claim 1, characterized in that the locking bolt is pressed into its locking position by the tensioning device with a predefined tensioning force, and in that when a resetting force is applied to the resetting member, the locking bolt is reset into the unlocking position in which the pin shaped coupling member can be axially displaced relative to the sleeve shaped coupling receptacle.

* * * * *